US009041307B1

(12) United States Patent
Yang et al.

(10) Patent No.: US 9,041,307 B1
(45) Date of Patent: May 26, 2015

(54) METHOD FOR BRIGHTNESS CONTROL

(71) Applicant: RICHTEK TECHNOLOGY CORP, Hsinchu (TW)

(72) Inventors: Huan-Chien Yang, Hsinchu (TW); Shui-Mu Lin, Hsinchu (TW); Shei-Chie Yang, Hsinchu (TW); Shih Chung Wang, Hsinchu (TW)

(73) Assignee: RICHTEK TECHNOLOGY CORP, Hsinchu (TW)

( * ) Notice: Subject to any disclaimer, the term of this patent is extended or adjusted under 35 U.S.C. 154(b) by 0 days.

(21) Appl. No.: 14/447,425

(22) Filed: Jul. 30, 2014

(30) Foreign Application Priority Data

Apr. 11, 2014 (TW) ..... 103113385 A

(51) Int. Cl.
*G05F 1/00* (2006.01)
*H05B 33/08* (2006.01)

(52) U.S. Cl.
CPC ..... *H05B 33/0851* (2013.01)

(58) Field of Classification Search
CPC ..... H05B 33/08
USPC ..... 315/291, 307, 224, 246–247, 312
See application file for complete search history.

(56) References Cited

U.S. PATENT DOCUMENTS

2011/0057576 A1* 3/2011 Otake et al. ..... 315/291
2011/0080111 A1* 4/2011 Nuhfer et al. ..... 315/291

* cited by examiner

*Primary Examiner* — Minh D A
(74) *Attorney, Agent, or Firm* — Chun-Ming Shih

(57) ABSTRACT

A method for brightness control, adapted to a light emitting device emitting a light of an output brightness, comprises: setting the output brightness to be an initial value, and controlling the light emitting device emitting the light accordingly; setting a target value, and controlling the output brightness changing from the initial value toward the target value with the brightness changing rate of the brightness zone corresponding to the initial value; controlling the output brightness changing toward the target value with the following brightness changing rate when the output brightness crossing one of the brightness thresholds and entering the following brightness zone, wherein the following brightness changing rate corresponds to the following brightness zone; stopping changing the output brightness when reaching the target value.

14 Claims, 9 Drawing Sheets

METHOD FOR BRIGHTNESS CONTROL

CROSS REFERENCE TO RELATED APPLICATIONS

This non-provisional application claims priority claim under 35 U.S.C. §119(a) on Patent Application No. 103113385 filed in Taiwan, R.O.C. on Apr. 11th, 2014, the entire contents of which are hereby incorporated by reference herein.

BACKGROUND OF THE INVENTION

1. Field of the Invention

This disclosure relates to a method for brightness control and, more particularly, to a method for brightness control, which is adapted to a light emitting device, capable of improving user experience, and having flexibility on system design.

2. Description of Related Art

FIG. 1 shows a waveform of brightness of a light emitting device controlled by prior arts. The initial value of the output brightness of the light emitting device is 0%, and the target value of that is set to be 100%. In FIG. 1, the waveforms, which are waveform 110 and 120, respectively corresponding to 2 different prior arts are shown. Waveform 110 shows that the output brightness is linearly changed from the initial 0% to target 100%, which is easier for system design and the required time to finish the change on the output brightness can be clearly estimated. However, the brightness changing rate is the same both for smaller brightness and larger brightness, which is not gentle for users and may cause uncomfortable visual feeling.

On the other hand, waveform 120 shows that the output brightness is exponentially changed, which takes advantage of relatively easier design on the control circuit of the light emitting device, such as a circuit formed by serially connecting resistors and capacitors. The exponentially changing brightness is relatively gentle for users and shows obvious gradation on brightness. By this way the user experience is improved comparing to the prior art shown by waveform 110. However, the changing time of the exponentially changing brightness is either not easy to be possessed or too long, which causes inconvenience on system design.

SUMMARY

In view of the foregoing, a method for brightness control is provided. More particularly, a method for brightness control, which is adapted to a light emitting device, capable of improving user experience, and having flexibility on system design, is provided.

This disclosure provides a method for brightness control, adapted to a light emitting device, which emits a light of an output brightness. A plurality of brightness thresholds exists in between the minimal value and the maximal value of the output brightness, and each zone between the neighboring brightness thresholds defines a brightness zone which is with a brightness changing rate. The method for brightness control comprises the steps of: setting the output brightness to be an initial value, and controlling the light emitting device emitting the light accordingly; setting a target value, and controlling the output brightness changing from the initial value toward the target value with the brightness changing rate of the brightness zone corresponding to the initial value; controlling the output brightness changing toward the target value with the following brightness changing rate when the output brightness crossing one of the brightness thresholds and entering the following brightness zone, wherein the following brightness changing rate corresponds to the following brightness zone; and, stopping changing the output brightness when reaching the target value.

In one embodiment of this disclosure, the brightness changing rate of the brightness zone with larger brightness is larger than the brightness changing rate of the brightness zone with smaller brightness.

In one embodiment of this disclosure, the brightness changing rate of the brightness zone with larger brightness is twice as large as the brightness changing rate of the neighboring brightness zone with smaller brightness.

In one embodiment of this disclosure, each brightness threshold is twice as large as the neighboring smaller brightness threshold.

In one embodiment of this disclosure, the method for brightness control further comprises an approaching target value existing in between the initial value and the target value, and a plurality of target brightness thresholds existing in between the approaching target value and the target value, wherein when the output brightness changes and crosses one of the approaching target value and the target brightness thresholds, the brightness changing rate, which the output brightness is proceeding with, is decreased.

In one embodiment of this disclosure, when the target value is larger than the initial value, the approaching target value is defined as the target value minus 10 percent of the difference of the target value and the initial value, and when the target value is smaller than the initial value, the approaching target value is defined as the target value plus 10 percent of the difference of the target value and the initial value.

In one embodiment of this disclosure, the light emitting device is a light emitting diode.

This disclosure also provides a method for brightness control, adapted to a light emitting device, which is driven by a driving current and emits a light of an output brightness positive-correlated to the driving current. A plurality of current thresholds exists in between the minimal value and the maximal value of the driving current, and each zone between the neighboring current thresholds defining a current zone which is with a current changing rate. The method for brightness control comprising the steps of: setting the output brightness to be an initial value corresponding to an initial current value, and driving the light emitting device by the driving current of the initial current value; setting a target value corresponding to a target current value, and controlling the driving current changing from the initial current value toward the target current value with the current changing rate of the current zone corresponding to the initial current value; controlling the driving current changing toward the target current value with the following current changing rate when the driving current crossing one of the current thresholds and entering the following current zone, wherein the following current changing rate corresponds to the following current zone; and, stopping changing the driving current when reaching the target current value.

In one embodiment of this disclosure, the current changing rate of the current zone with larger current is larger than the current changing rate of the current zone with smaller current.

In one embodiment of this disclosure, the current changing rate of the current zone with larger current is twice as large as the current changing rate of the neighboring current zone with smaller current.

In one embodiment of this disclosure, each current threshold is twice as large as the neighboring smaller current threshold.

In one embodiment of this disclosure, the method for brightness control further comprises an approaching target current value existing in between the initial current value and the target current value, and a plurality of target current thresholds exists in between the approaching target current value and the target current value, wherein when the driving current changes and crosses one of the approaching target current value and the target current thresholds, the current changing rate, which the driving current is proceeding with, is decreased.

In one embodiment of this disclosure, when the target current value is larger than the initial current value, the approaching target current value is defined as the target current value minus 10 percent of the difference of the target current value and the initial current value, and when the target current value is smaller than the initial current value, the approaching target current value is defined as the target current value plus 10 percent of the difference of the target current value and the initial current value.

In one embodiment of this disclosure, the light emitting device is a light emitting diode.

The advantageous effect of this disclosure over conventional approaches is that the disclosed method for brightness control of this disclosure adopts "piece-wise linear" algorithm on the design of brightness changing. That is to say, firstly a plurality of brightness zones are defined, and then corresponding brightness changing rate is assigned to each of the brightness zones to present different effects when the brightness of a light emitting device is adjusted, which can bring better user experience and achieve flexible system design.

BRIEF DESCRIPTION OF THE DRAWINGS

The structure as well as a preferred mode of use, further objects, and advantages of this disclosure will be best understood by referring to the following detailed description of some illustrative embodiments in conjunction with the accompanying drawings, in which.

DETAILED DESCRIPTION OF THE EMBODIMENTS

Figure 1:
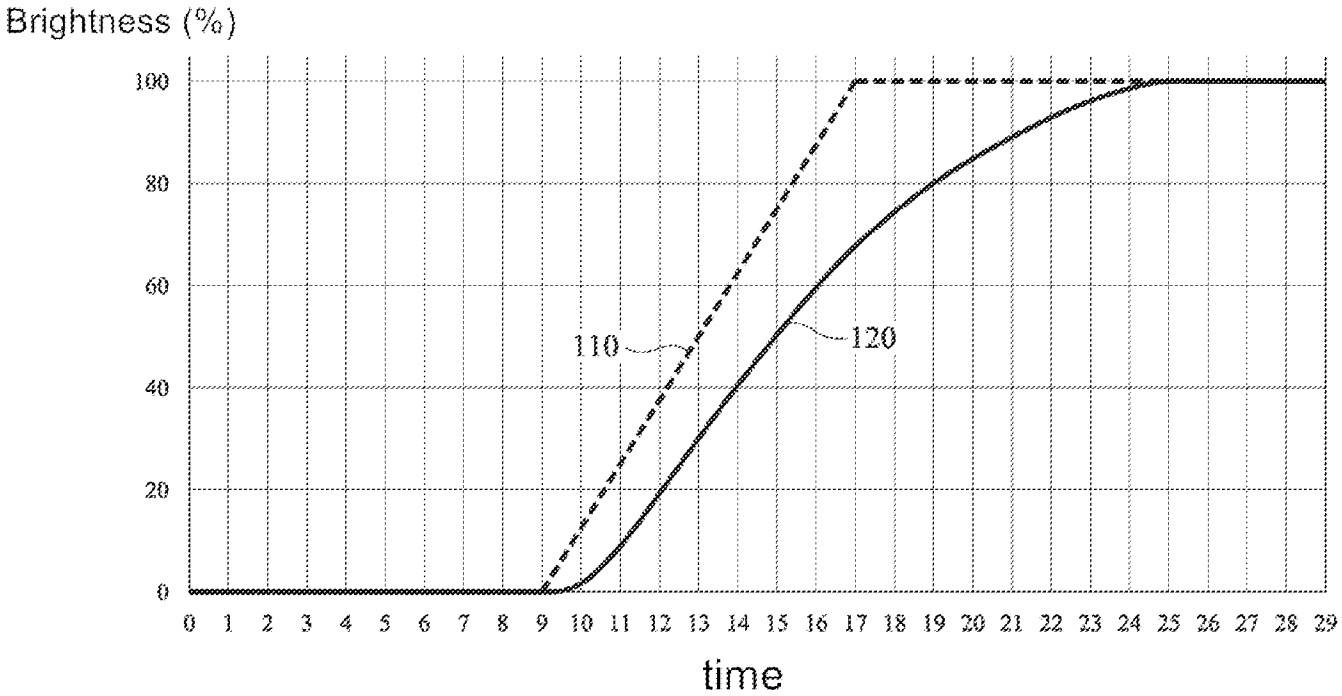
FIG. 1 (PRIOR ART)
FIG. 1 is a waveform of brightness of a light emitting device controlled by prior arts.
Figure 2:
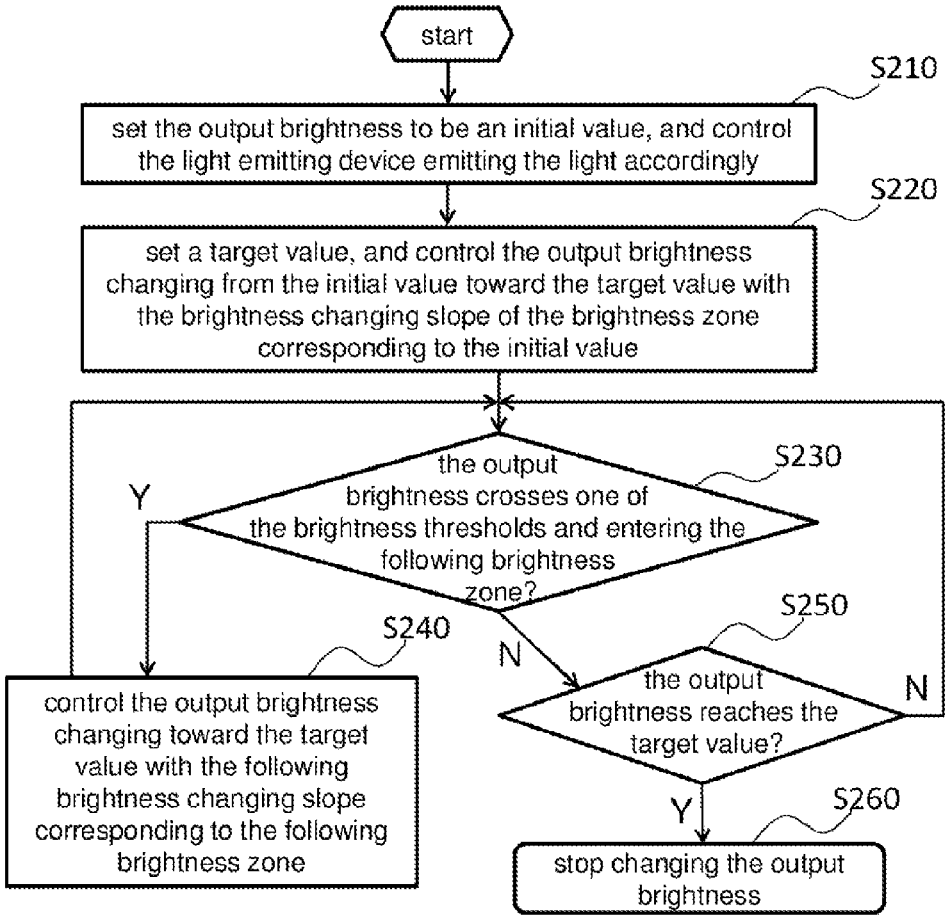
FIG. 2 is a flowchart of the first embodiment of the method for brightness control of this disclosure.

FIG. 2 is a flowchart of the first embodiment of the method for brightness control of this disclosure. The method for brightness control of this disclosure is adapted to a light emitting device, which emits a light of an output brightness. A plurality of brightness thresholds exist in between the minimal value and the maximal value of the output brightness, and each zone between the neighboring brightness thresholds defines a brightness zone which is with a brightness changing rate. The method for brightness control includes the following steps:

The first step: set the output brightness to be an initial value, and control the light emitting device emitting the light accordingly. As is shown in step S210.

The second step: set a target value, and control the output brightness changing from the initial value toward the target value with the brightness changing rate of the brightness zone corresponding to the initial value. As is shown in step S220.

The third step: control the output brightness changing toward the target value with the following brightness changing rate when the output brightness crosses one of the brightness thresholds and entering the following brightness zone, wherein the following brightness changing rate corresponds to the following brightness zone. As is shown in step S230 and S240. In more detail, in step S230, if the decision of "the output brightness crosses one of the brightness thresholds and entering the following brightness zone" is "yes", enter step S240 executing "control the output brightness changing toward the target value with the following brightness changing rate corresponding to the following brightness zone" and go back to step S230. If the decision of step S230 is "no", enter step S250.

The fourth step: stop changing the output brightness when reaching the target value. As is shown in step S250 and S260. In more detail, in step S250, if the decision of "the output brightness reaches the target value" is "yes", enter step S260 executing "stop changing the output brightness" and end the process. If the decision of step S250 is "no", go back to step S230.

Besides, in the first embodiment of the method for brightness control of this disclosure, it may be further defined that the brightness changing rate of the brightness zone with larger brightness is larger than the brightness changing rate of the brightness zone with smaller brightness. For example, the brightness changing rate of the brightness zone with larger brightness is twice as large as the brightness changing rate of the neighboring brightness zone with smaller brightness. It can also be further defined that each brightness threshold is twice as large as the neighboring smaller brightness threshold.

Figure 3:
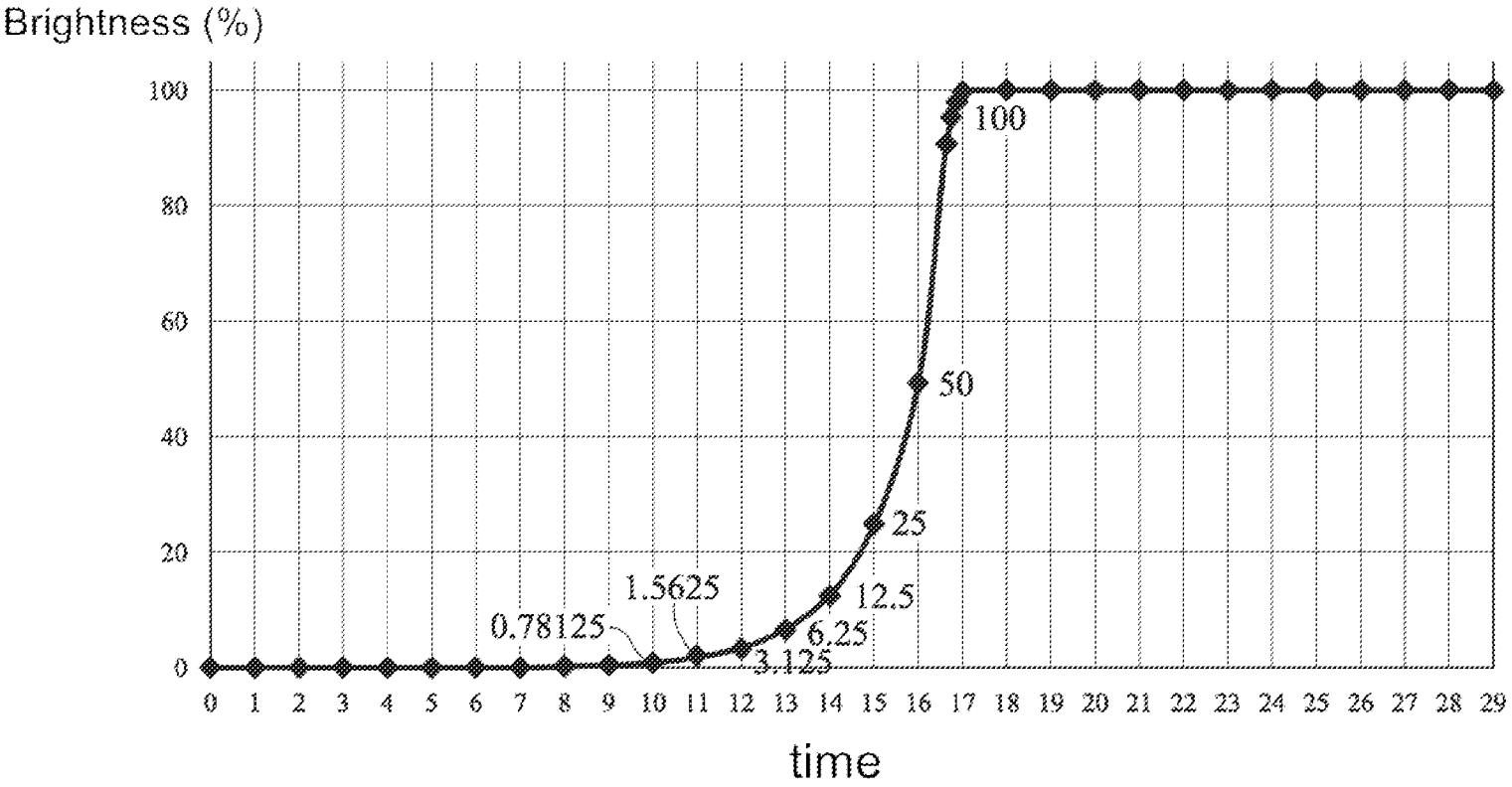
FIG. 3 is a waveform of brightness of a light emitting device controlled by the first embodiment of the method for brightness control of this disclosure.

FIG. 3 is a waveform of brightness of a light emitting device controlled by the first embodiment of the method for brightness control of this disclosure. In the method for brightness control disclosed in FIG. 3, brightness thresholds of 0.78125%, 1.5625%, 3.125%, 6.25%, 12.5%, 25% and 50% are defined respectively, and six brightness zones, each of which is between the neighboring brightness thresholds, are formed. The brightness changing rates corresponding from the smallest brightness zone to the largest brightness zone are 0.78125%, 1.5625%, 3.125%, 6.25%, 12.5%, 25% per time unit respectively. That is to say, the brightness changing rate of the brightness zone with larger brightness is twice as large as the brightness changing rate of the neighboring brightness zone with smaller brightness, and each brightness threshold is twice as large as the neighboring smaller brightness threshold.

The waveform of brightness changing in FIG. 3 shows that when the brightness is small, the changing rate of the brightness of the light emitting device is also smaller; on the other hand, when the brightness becomes larger, the changing rate of the brightness of the light emitting device is higher. There are at least two advantages to adopt the method of the brightness control disclosed in the first embodiment. First, when the brightness is smaller, the changing of the brightness is also slower. Therefore, it is perceptible for user the continuous changing of the small brightness, and the user experience is improved. Second, it is convenient for the system design that the required time for brightness changing is easy to be estimated.

Figure 4:
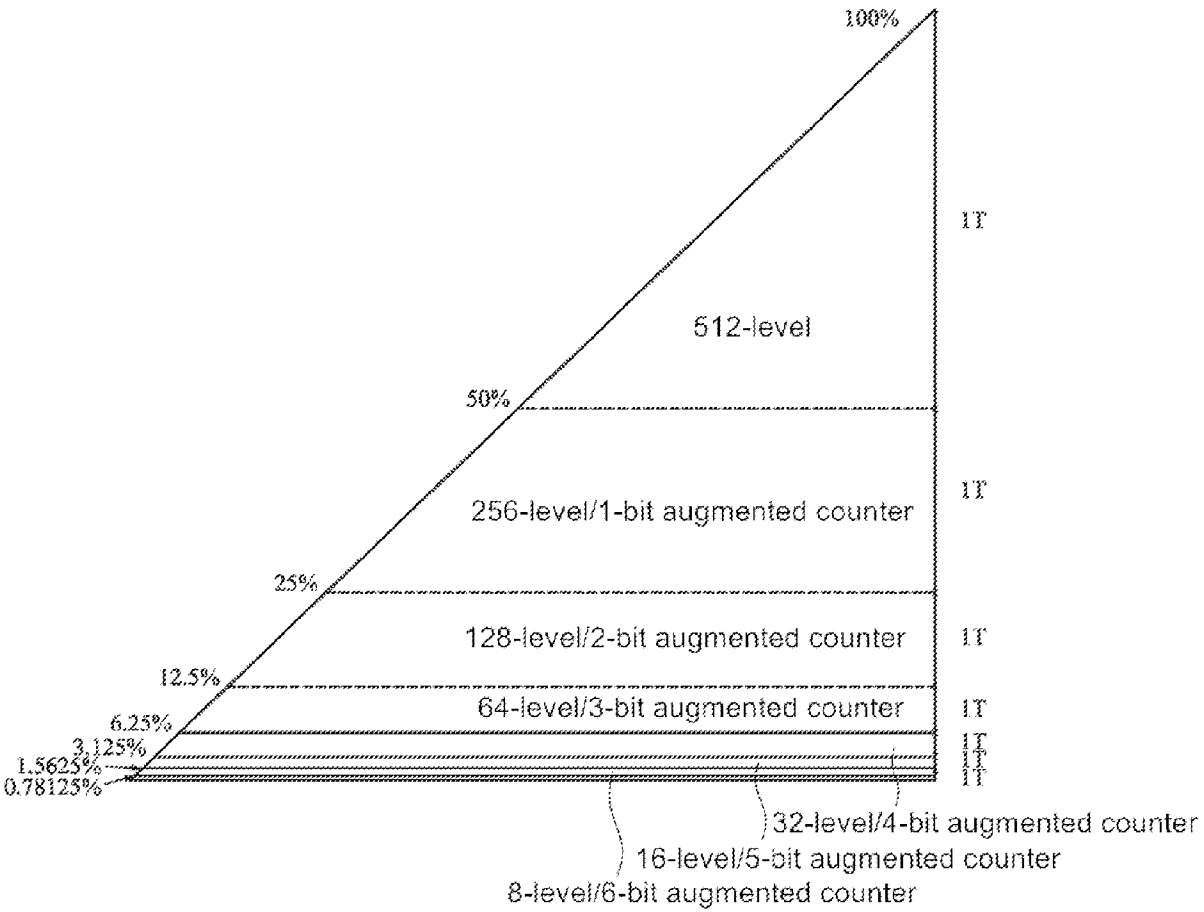
FIG. 4 is one detailed embodiment of the first embodiment of the method for brightness control of this disclosure.

FIG. 4 is one detailed embodiment of the first embodiment of the method for brightness control of this disclosure. Assume that the method for brightness control of this disclosure is adopted in a system using an up/down counter of 10-bit resolution to control the output brightness of the light emitting device, thus, totally 1024 brightness levels can be defined by and mapped to the 10-bit resolution. As the result, the minimal brightness changing is 100%/1024=0.09765625%, which is defined as "1-level" changing in the following description of this embodiment.

When the output brightness of the light emitting device increases from 25% to 50%, an operation of 256-level changing is required. Also, in the brightness zone of 25%~50%, a 1-bit augmented counter is adopted to perform counting with a clock of period t. When the 1-bit augmented counter counts from 0 to 1, the output brightness of the light emitting device is increased (or decreased) with 1-level and the 1-bit augmented counter is reset to 0 concurrently. That is to say, the required time to increase the output brightness with 1-level is 2t in this brightness zone. Assume the required time to increase the output brightness from 25% to 50% is 1T, then 1T=256*2t=512t. As the result, the brightness changing rate in the brightness zone of 25%~50% is 25%/1T.

In more detail, when the output brightness of the light emitting device increases from 12.5% to 25%, an operation of 128-level changing is required. Also, in the brightness zone of 12.5%~25%, a 2-bit augmented counter is adopted to perform counting with a clock of period t. When the 2-bit augmented counter counts from 0 to 3, the output brightness of the light emitting device is increased (or decreased) with 1-level and the 2-bit augmented counter is reset to 0 concurrently. That is to say, the required time to increase the output brightness with 1-level is 4t in this brightness zone. So the required time to increase the output brightness from 1.25% to 25% is 128*4t=512t. As the result, the brightness changing rate in the brightness zone of 12.5%~25% is 12.5%/1T.

According to the aforementioned description of this embodiment, if a 6-bit, a 5-bit, a 4-bit, a 3-bit, a 2-bit and a 1-bit augmented counters are respectively adopted in the six brightness zones from low to high to perform brightness changing, the required time to entirely cross every brightness zone is 1T. Besides, the brightness changing rates, which are 0.78125%/1T, 1.5625%/1T, 3.125%/1T, 6.25%/1T, 12.5%/1T, 25%/1T respectively, are doubly increased gradually for the six brightness zones from low to high. Besides, for the brightness zone of 50%-100%, no augmented counter is required. The clock of period t can be adopted to perform 1-level brightness changing directly, thus, the required time to increase the output brightness from 50% to 100% is also 512t. To sum up, according to the operation shown by FIG. 4, the waveform of the brightness changing is the same as that shown in FIG. 3.

Figure 5:
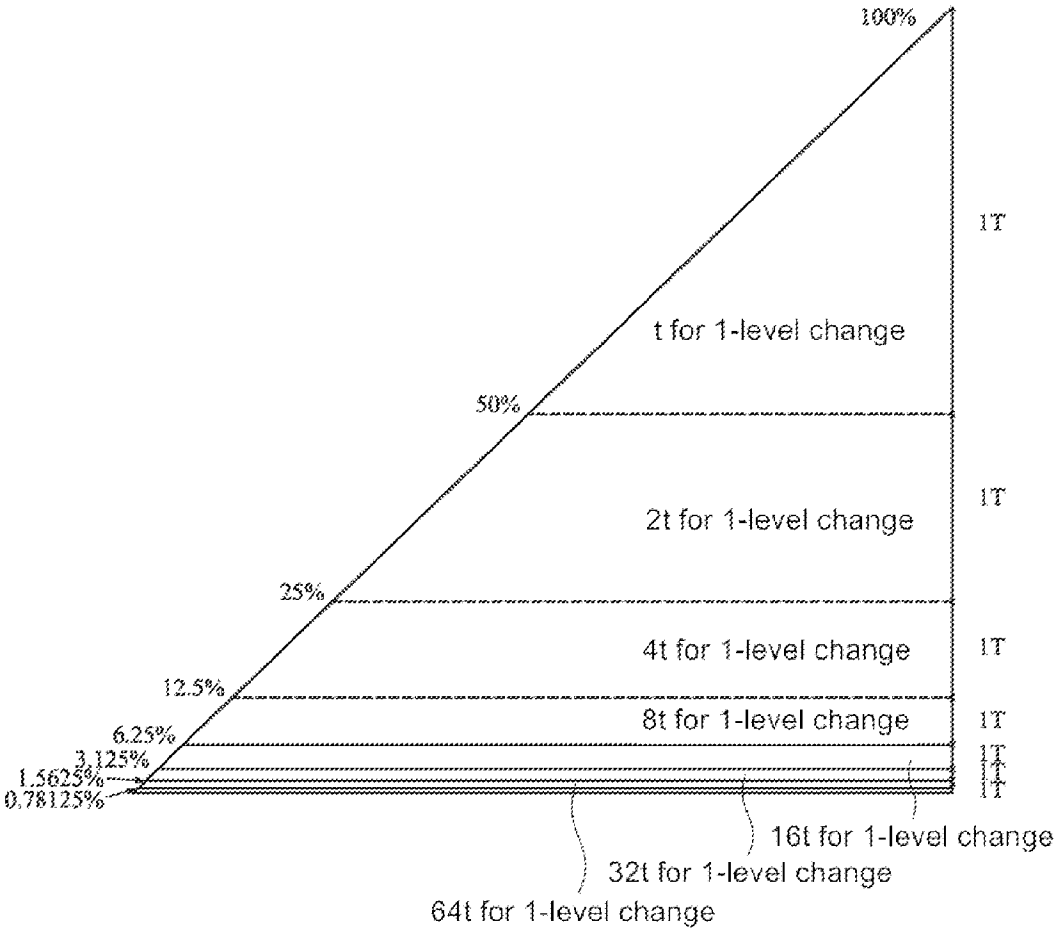
FIG. 5 is another detailed embodiment of the first embodiment of the method for brightness control of this disclosure.

FIG. 5 is another detailed embodiment of the first embodiment of the method for brightness control of this disclosure. Assume that the method for brightness control of this disclosure is adopted in a system using an up/down counter of 10-bit resolution to control the output brightness of the light emitting device, thus, totally 1024 brightness levels can be defined by and mapped to the 10-bit resolution. As the result, the minimal brightness changing is 1/1024=0.09765625%, which is defined as "1-level" changing in the description of this embodiment.

When the output brightness of the light emitting device increases from 25% to 50%, an operation of 256-level changing is required. Also, in the brightness zone of 25%~50%, a clock of period 2t is adopted to perform up-counting or down-counting on the 10-bit up/down counter. When the up/down counter counts 1 step upward (or downward), the output brightness of the light emitting device is increased (or decreased) with 1-level. That is to say, the required time to increase the output brightness with 1-level is 2t in this brightness zone. Assume the required time to increase the output brightness from 25% to 50% is 1T, then 1T=256*2t=512t. As the result, the brightness changing rate in the brightness zone of 25%~50% is 25%/1T.

In more detail, when the output brightness of the light emitting device increases from 12.5% to 25%, an operation of 128-level changing is required. Also, in the brightness zone of 12.5%~25%, a clock of period 4t is adopted to perform up-counting or down-counting on the 10-bit up/down counter. When the up/down counter counts 1 step upward (or downward), the output brightness of the light emitting device is increased (or decreased) with 1-level. That is to say, the required time to increase the output brightness with 1-level is 4t in this brightness zone. So the required time to increase the output brightness from 12.5% to 25% is 128*4t=512t. As the result, the brightness changing rate in the brightness zone of 12.5%~25% is 12.5%/1T.

According to the aforementioned description of this embodiment, if clocks of period 64t, 32t, 16t, 8t, 4t and 2t are respectively adopted in the six brightness zones from low to high to perform brightness changing, the required time to entirely cross every brightness zone is 1T. Besides, the brightness changing rates, which are 0.78125%/1T, 1.5625%/1T, 3.125%/1T, 6.25%/1T, 12.5%/1T, 25%/1T respectively, are doubly increased gradually for the six brightness zones from low to high. For the brightness zone of 50%~100%, the clock of period t can be adopt to perform 1-level brightness changing directly, thus, the required time to increase the output brightness from 50% to 100% is also 512t. To sum up, according to the operation shown by FIG. 5, the waveform of the brightness changing is the same as that shown in FIG. 3.

It is noted that the two detailed embodiments disclosed in FIG. 4 and FIG. 5 respectively can be adopted concurrently in the brightness control of a light emitting device to optimize the tradeoff between design complexity and hardware cost. For example, the augmented counters adopted in the brightness zone of smaller brightness require more bits to perform counting, which may induce extra hardware cost. Therefore, augmented counters with lesser bits can be adopted and counted with clocks of longer period, which achieves the same function of crossing every entirely brightness zone with the same time and also saves the hardware cost. It is easy for people skilled in the art to perform design change or adopt other design topologies to implement the invention disclosed in this paragraph. The details will not be described further.

It is also noted that the first embodiment of the method for brightness control of this disclosure can be understood as adopting "piece-wise linear" algorithm on the design of brightness changing. That is to say, firstly a plurality of brightness zones are defined, and then corresponding brightness changing rate is assigned to each of the brightness zones to present different effects when the brightness of a light emitting device is adjusted, which can bring better user experience and achieve flexible system design. Note that the embodiments shown from FIG. 3 to FIG. 5 are for description purpose to prove that this disclosure is one of the optimized ways to perform brightness control, but not to limit the scope of this disclosure. People skilled in the art can design different brightness changing waveforms according to this disclosure after fully understanding the embodiments disclosed in the application.

Figure 6:
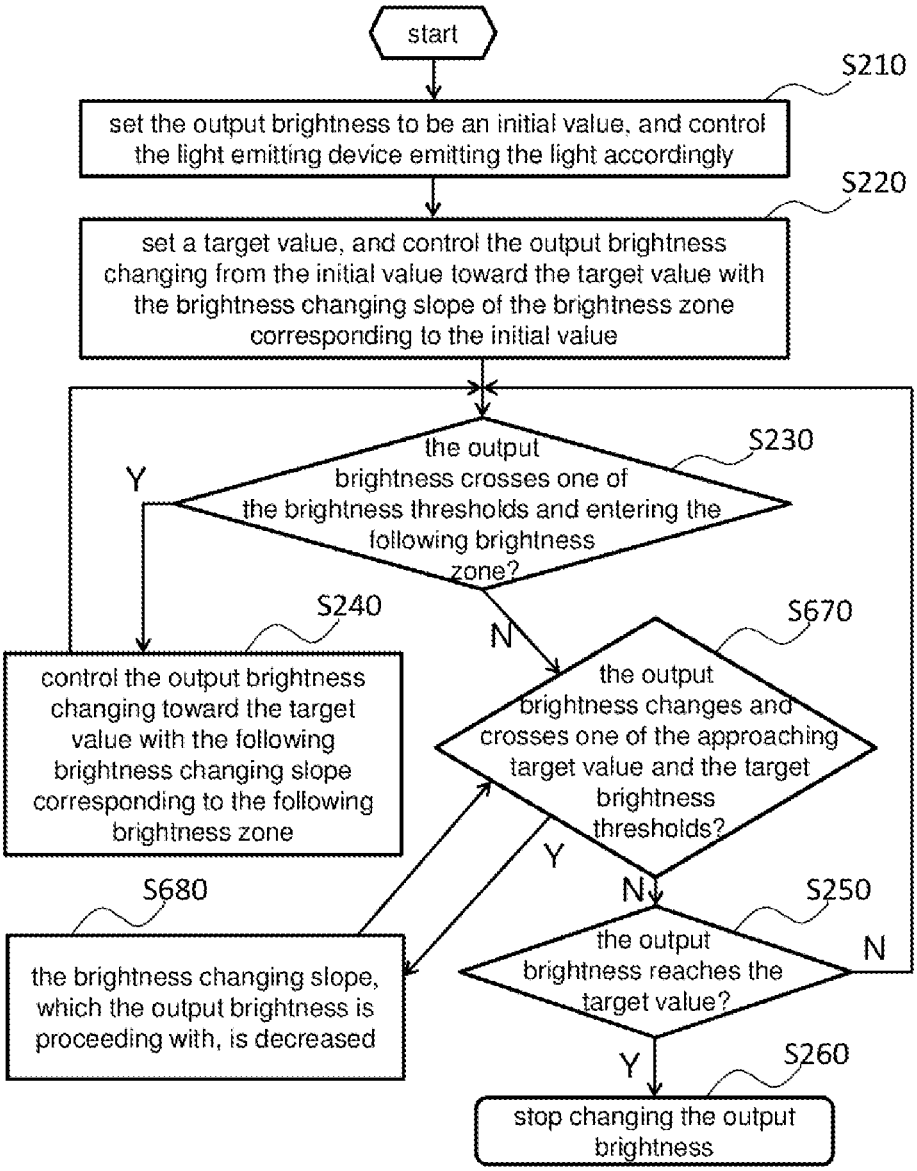
FIG. 6 is a flowchart of the second embodiment of the method for brightness control of this disclosure.

FIG. 6 is a flowchart of the second embodiment of the method for brightness control of this disclosure. In the following descriptions, only the difference between FIG. 6 and FIG. 2 are interpreted, and the rest parts of FIG. 6 can be directly referred to the descriptions of FIG. 2.

In the second embodiment of the method for brightness control of this disclosure shown in FIG. 6, an approaching target value exists in between the initial value and the target value is further included compared to the first embodiment, and a plurality of target brightness thresholds exist in between the approaching target value and the target value. When the output brightness changes and crosses one of the approaching target value and the target brightness thresholds, the brightness changing rate, which the output brightness is proceeding with, is decreased. As is shown in step S670 and S680. In more detail, in step S230, if the decision of "the output brightness crosses one of the brightness thresholds and entering the following brightness zone" is "no", enter step S670 (instead of entering step S250 as is shown in FIG. 2). And in step S670, if the decision of "the output brightness changes and crosses one of the approaching target value and the target brightness thresholds" is "yes", enter step S680 executing "the brightness changing rate, which the output brightness is proceeding with, is decreased", and go back to step S670. If the decision of step S670 is "no", go back to step S250.

Besides, in the second embodiment of the method for brightness control of this disclosure, it can be further defined that when the target value is larger than the initial value, the approaching target value is defined as "the target value" minus "10 percent of the difference of the target value and the initial value"; when the target value is smaller than the initial value, the approaching target value is defined as "the target value" plus "10 percent of the difference of the target value and the initial value".

Figure 7:
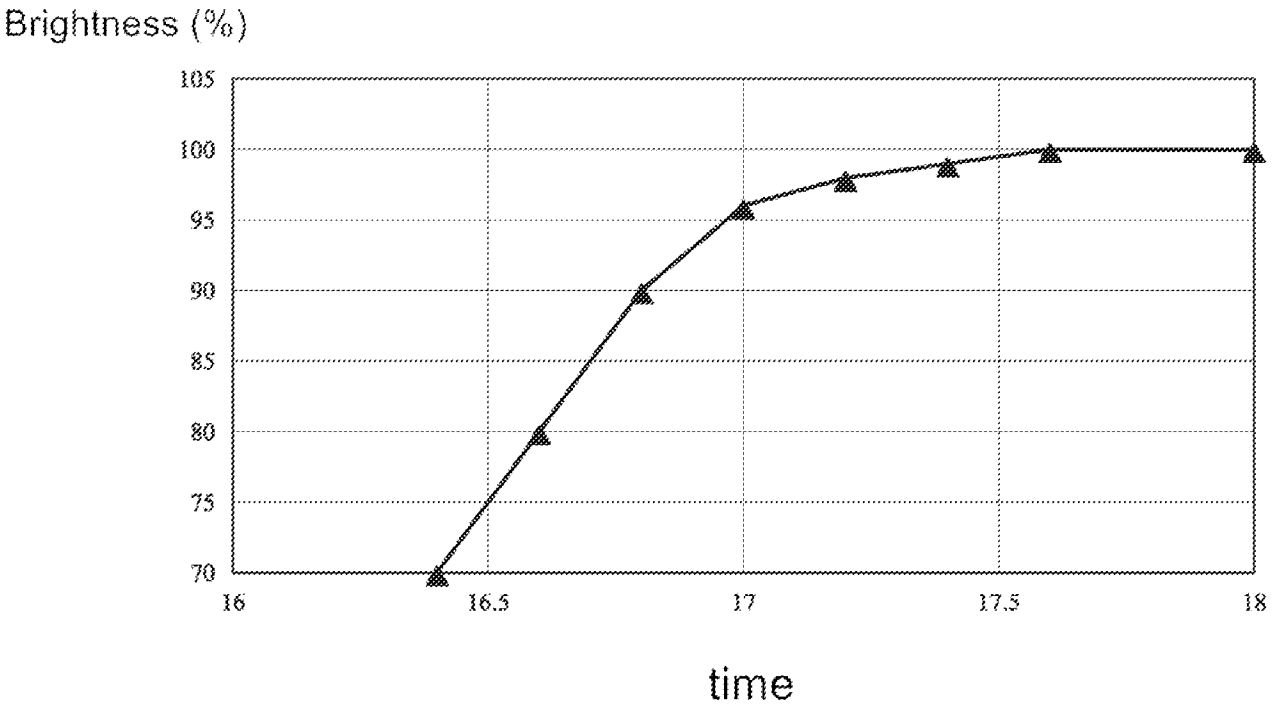
FIG. 7 is a waveform of brightness of a light emitting device controlled by the second embodiment of the method for brightness control of this disclosure.

FIG. 7 is a waveform of brightness of a light emitting device controlled by the second embodiment of the method for brightness control of this disclosure. As shown in FIG. 7, the output brightness of the light emitting device changes from 0% to 100%, that is, the target value 100% is larger than the initial value 0%. The approaching target value is defined as the target value minus 10 percent of the difference of the target value and the initial value, that is, that approaching target value is 90% in this example. There are also three target brightness thresholds, which are 96%, 97.5% and 99%, in between the approaching target value and the target value. When the output brightness changes and crosses 90%, 96%, 97.5% or 99%, the brightness changing rate, which the output brightness is proceeding with, is decreased. Finally the target value 100% is reached.

In the second embodiment of this disclosure, the advantages of the first embodiment are included. Further, in the second embodiment, the way that the brightness changing rate is decreased gradually when the output brightness is near the target value can avoid the output brightness suddenly stop at the target value, which is even more gentle to the visual feeling of user, and the user experience is further improved.

It is noted that the design value shown in FIG. 7, for example, the approaching target value 90%, the target brightness threshold 96%, 97.5% and 99%, are chosen for description purpose, but not to limit the scope of this disclosure. The main idea of the second embodiment of this disclosure is that when the output brightness is near the target value, the brightness changing rate is decreased gradually. The detailed implementation and setup depends on various application requirements. People skilled in the art can implement this disclosure according to various applications after fully understanding the aforementioned embodiments.

In the first and second embodiments of the method for brightness control of this disclosure, the output brightness is directly controlled to change linearly in each brightness zone. However, for most light emitting devices, the relation of the driving current and the output brightness according to are not exactly linear. Therefore, unless a calibration process is performed in advance to derive the linear relation between control signal and the output brightness of the light emitting device, it is not easy to implement the method of linearly controlling the output brightness. For example, for a light emitting diode, the relation between the output brightness and the driving current is merely positive-correlated, but not exactly linear. As the result, if the driving current, instead of the output brightness, of the light emitting device is linearly controlled directly, the complexity of the design of the control circuit of the light emitting device is alleviated greatly. Based to this, the third and the fourth embodiments of this disclosure are disclosed hereinafter.

Figure 8:
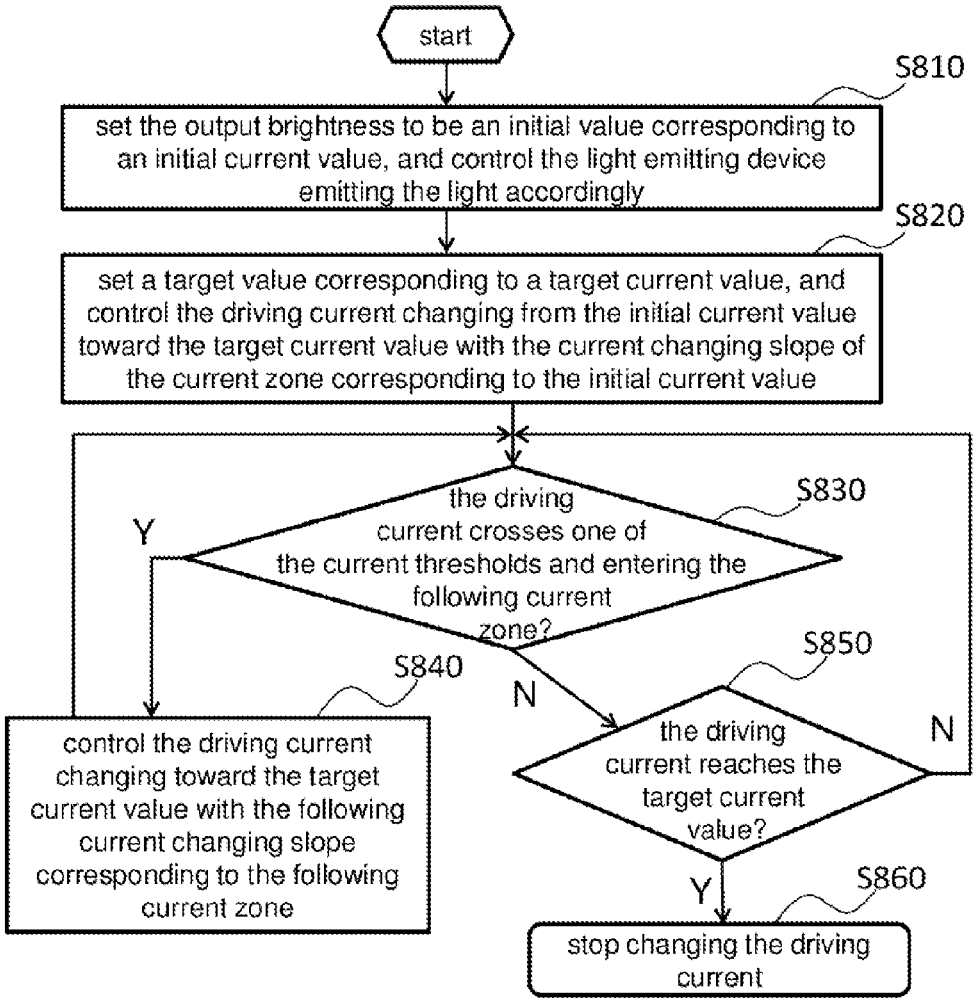
FIG. 8 is a flowchart of the third embodiment of the method for brightness control of this disclosure.

FIG. 8 is a flowchart of the third embodiment of the method for brightness control of this disclosure. The method for brightness control of this disclosure is adapted to a light emitting device, which is driven by a driving current and emits a light of an output brightness positive-correlated to the driving current. A plurality of current thresholds exist in between the minimal value and the maximal value of the driving current, and each zone between the neighboring current thresholds defines a current zone which is with a current changing rate. The method for brightness control includes the following steps:

The first step: set the output brightness to be an initial value corresponding to an initial current value, and control the light emitting device emitting the light accordingly. As is shown in step S810.

The second step: set a target value corresponding to a target current value, and control the driving current changing from the initial current value toward the target current value with the current changing rate of the current zone corresponding to the initial current value. As is shown in step S820.

The third step: control the driving current changing toward the target current value with the following current changing rate when the driving current crosses one of the current thresholds and entering the following current zone, wherein the following current changing rate corresponds to the following current zone. As is shown in step S830 and S840. In more detail, in step S830, if the decision of "the driving current crosses one of the current thresholds and entering the following current zone" is "yes", enter step S840 executing "control the driving current changing toward the target current value with the following current changing rate corresponding to the following current zone" and go back to step S830. If the decision of step S830 is "no", enter step S850.

The fourth step: stop changing the driving current when reaching the target current value. As is shown in step S850 and S860. In more detail, in step S850, if the decision of "the driving current reaches the target current value" is "yes", enter step S860 executing "stop changing the driving current" and end the process. If the decision of step S850 is "no", go back to step S830.

Besides, in the third embodiment of the method for brightness control of this disclosure, it may be further defined that the current changing rate of the current zone with larger driving current is larger than the current changing rate of the current zone with smaller driving current. For example, the current changing rate of the current zone with larger driving current is twice as large as the current changing rate of the neighboring current zone with smaller driving current. It can also be further defined that each current threshold is twice as large as the neighboring smaller current threshold.

The possible waveforms and ways of implementation for the third embodiment of the method for brightness control of this disclosure can be referred to FIG. 3, FIG. 4, FIG. 5 and the relating descriptions thereof, wherein the control on the output brightness is replaced by the control on the driving current. People skilled in the art can directly know the ways to implement the third embodiment of the method for brightness control of this disclosure after fully understanding the embodiments disclosed in FIG. 3, FIG. 4 and FIG. 5.

In the third embodiment of this disclosure, the advantages of the first embodiment are included. Further, in the third embodiment, since the calibration and the compensation on the driving current itself is easy to be implemented in applications, it is relatively easy to linearly control the driving current, thus, the cost is reduced and the complexity on system design is alleviated.

Figure 9:
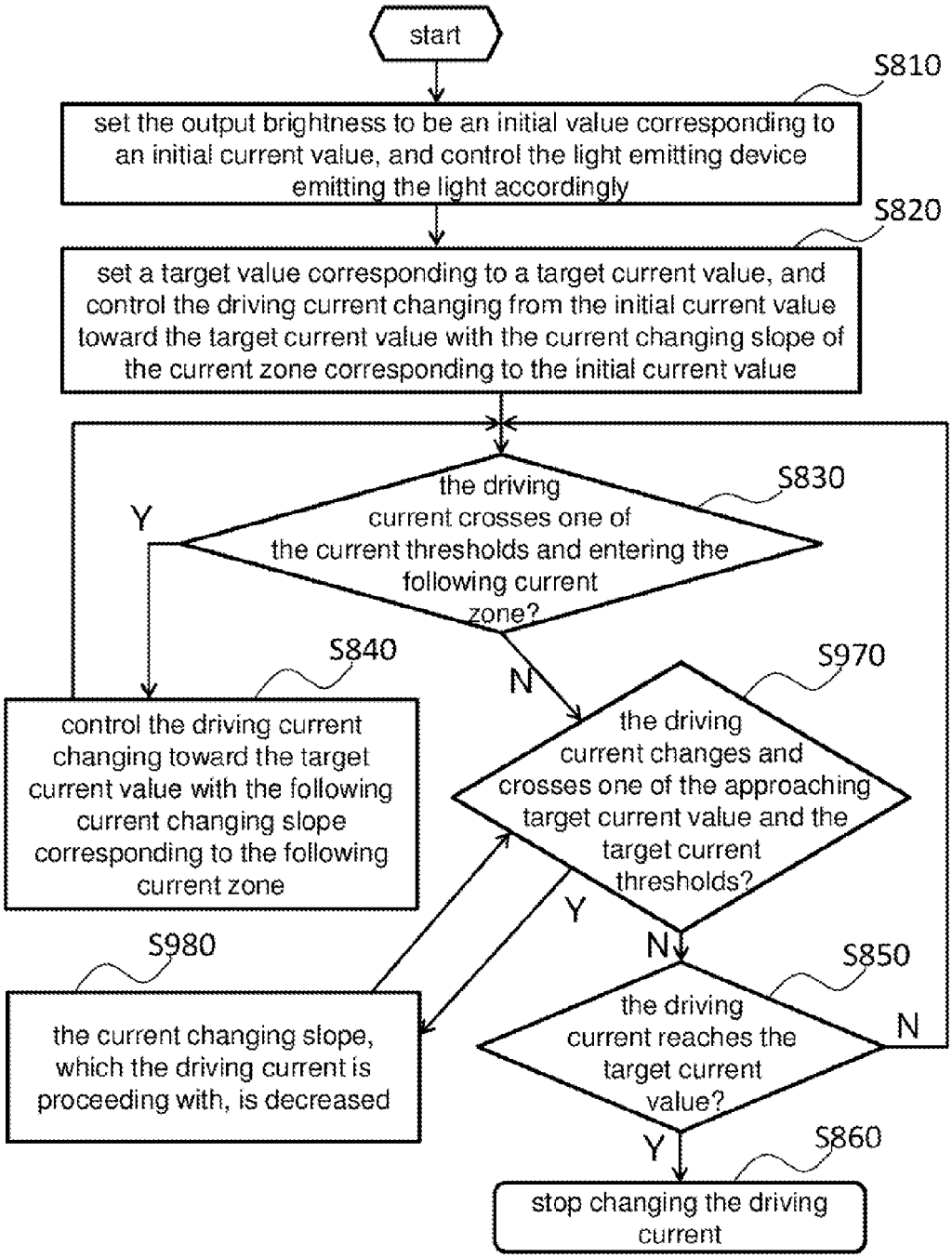
FIG. 9 is a flowchart of the fourth embodiment of the method for brightness control of this disclosure.

FIG. 9 is a flowchart of the fourth embodiment of the method for brightness control of this disclosure. In the following descriptions, only the difference between FIG. 9 and FIG. 8 are interpreted, and the rest parts of FIG. 9 can be directly referred to the descriptions of FIG. 8.

In the fourth embodiment of the method for brightness control of this disclosure shown in FIG. 9, an approaching target current value exists in between the initial current value and the target current value is further included compared to the third embodiment, and a plurality of target current thresholds exist in between the approaching target current value and the target current value. When the driving current changes and crosses one of the approaching target current value and the target current thresholds, the current changing rate, which the driving current is proceeding with, is decreased. As is shown in step S970 and S980. In more detail, in step S830, if the decision of "the driving current crosses one of the brightness current thresholds and entering the following current zone" is "no", enter step S970 (instead of entering step S850 as is shown in FIG. 8). And in step S970, if the decision of "the driving current changes and crosses one of the approaching target current value and the target current thresholds" is "yes", enter step S980 executing "the current changing rate, which the driving current is proceeding with, is decreased", and go back to step S970. If the decision of step S970 is "no", go back to step S850.

Besides, in the fourth embodiment of the method for brightness control of this disclosure, it can be further defined that when the target current value is larger than the initial current value, the approaching target current value is defined as "the target current value" minus "10 percent of the difference of the target current value and the initial current value"; when the target current value is smaller than the initial current value, the approaching target current value is defined as "the target current value" plus "10 percent of the difference of the target current value and the initial current value".

The possible waveforms and ways of implementation for the fourth embodiment of the method for brightness control of this disclosure can be referred to FIG. 7 and the relating descriptions thereof, wherein the control on the output brightness is replaced by the control on the driving current. People skilled in the art can directly know the ways to implement the fourth embodiment of the method for brightness control of this disclosure after fully understanding the embodiments disclosed in FIG. 7.

In the fourth embodiment of this disclosure, the advantages of the second embodiment are included. Further, in the fourth embodiment, since the calibration and the compensation on the driving current itself is easy to be implemented in applications, it is relatively easy to linearly control the driving current, thus, the cost is reduced and the complexity on system design is alleviated.

It is noted that the light emitting device in the above-mentioned embodiments and examples can be a light emitting diode, which is prevailing and adaptive to be controlled by a driving current in direct-current (DC) or pulse-width modulation (PWM) form. There are other kinds of light-emitting devices can also be adaptive to the method for brightness control of this disclosure, of which the characteristics are well-known to people skilled in the art, and will not be described further.

The foregoing embodiments are illustrative of the characteristics of this disclosure to enable a person skilled in the art to understand the disclosed subject matter and implement this disclosure accordingly. The embodiments, however, are not intended to restrict the scope of this disclosure. Hence, all equivalent modifications and variations made in the foregoing embodiments without departing from the spirit and principles of this disclosure should fall within the scope of the appended claims.

What is claimed is:

1. A method for brightness control, adapted to a light emitting device which emits a light of an output brightness, a plurality of brightness thresholds existing in between the minimal value and the maximal value of said output brightness, and each zone between the neighboring brightness thresholds defining a brightness zone which is with a brightness changing rate, said method for brightness control comprising the steps of:

setting said output brightness to be an initial value, and controlling said light emitting device emitting said light accordingly;

setting a target value, and controlling said output brightness changing from said initial value toward said target value with said brightness changing rate of said brightness zone corresponding to said initial value;

controlling said output brightness changing toward said target value with the following brightness changing rate when said output brightness crossing one of said brightness thresholds and entering the following brightness zone, wherein said following brightness changing rate corresponds to said following brightness zone; and stopping changing said output brightness when reaching said target value.

2. The method for brightness control as of claim 1, wherein said brightness changing rate of the brightness zone with larger brightness is larger than said brightness changing rate of the brightness zone with smaller brightness.

3. The method for brightness control as of claim 1, wherein said brightness changing rate of the brightness zone with larger brightness is twice as large as said brightness changing rate of the neighboring brightness zone with smaller brightness.

4. The method for brightness control as of claim 1, wherein each brightness threshold is twice as large as the neighboring smaller brightness threshold.

5. The method for brightness control as of claim 1, further comprising an approaching target value existing in between said initial value and said target value, and a plurality of target brightness thresholds existing in between said approaching target value and said target value, wherein when said output brightness changes and crosses one of said approaching target value and said target brightness thresholds, said brightness changing rate, which said output brightness is proceeding with, is decreased.

6. The method for brightness control as of claim 5, wherein when said target value is larger than said initial value, said approaching target value is defined as said target value minus 10 percent of the difference of said target value and said initial value, and when said target value is smaller than said initial value, said approaching target value is defined as said target value plus 10 percent of the difference of said target value and said initial value.

7. The method for brightness control as of claim 1, wherein said light emitting device is a light emitting diode.

8. A method for brightness control, adapted to a light emitting device, which is driven by a driving current and emits a light of an output brightness positive-correlated to said driving current, a plurality of current thresholds existing in between the minimal value and the maximal value of said driving current, and each zone between the neighboring current thresholds defining a current zone which is with a current changing rate, said method for brightness control comprising the steps of:

setting said output brightness to be an initial value corresponding to an initial current value, and driving said light emitting device by said driving current of said initial current value;

setting a target value corresponding to a target current value, and controlling said driving current changing from said initial current value toward said target current value with said current changing rate of said current zone corresponding to said initial current value;

controlling said driving current changing toward said target current value with the following current changing rate when said driving current crossing one of said current thresholds and entering the following current zone, wherein said following current changing rate corresponds to said following current zone; and stopping changing said driving current when reaching said target current value.

9. The method for brightness control as of claim 8, wherein said current changing rate of the current zone with larger current is larger than said current changing rate of the current zone with smaller current.

10. The method for brightness control as of claim 8, wherein said current changing rate of the current zone with larger current is twice as large as said current changing rate of the neighboring current zone with smaller current.

11. The method for brightness control as of claim 8, wherein each current threshold is twice as large as the neighboring smaller current threshold.

12. The method for brightness control as of claim 8, further comprising an approaching target current value existing in between said initial current value and said target current value, and a plurality of target current thresholds existing in between said approaching target current value and said target current value, wherein when said driving current changes and crosses one of said approaching target current value and said target current thresholds, said current changing rate, which said driving current is proceeding with, is decreased.

13. The method for brightness control as of claim 12, wherein when said target current value is larger than said initial current value, said approaching target current value is defined as said target current value minus 10 percent of the difference of said target current value and said initial current value, and when said target current value is smaller than said initial current value, said approaching target current value is defined as said target current value plus 10 percent of the difference of said target current value and said initial current value.

14. The method for brightness control as of claim 8, wherein said light emitting device is a light emitting diode.

* * * * *